US006527250B1

(12) United States Patent
Tyson

(10) Patent No.: US 6,527,250 B1
(45) Date of Patent: Mar. 4, 2003

(54) DEVICE FOR PULLING A PLANTED POST FROM THE GROUND

(76) Inventor: Rick Tyson, 2810 S. Agnew, Oklahoma City, OK (US) 73120

( * ) Notice: Subject to any disclaimer, the term of this patent is extended or adjusted under 35 U.S.C. 154(b) by 0 days.

(21) Appl. No.: 10/092,807

(22) Filed: Mar. 7, 2002

(51) Int. Cl.[7] ..... E21B 19/00
(52) U.S. Cl. ..... 254/30
(58) Field of Search ..... 254/30, 95, 132, 254/129, 120, 131, 133 R, 97, DIG. 4, 29 R, 113, 116; 81/124.3, 124.4; 269/70; 294/82.21, 82.23

(56) References Cited

U.S. PATENT DOCUMENTS 3,762,687 A * 10/1973 De Rome ..... 254/30
3,773,292 A * 11/1973 Thiermann ..... 254/30
4,250,769 A * 2/1981 Herring ..... 74/525
4,726,565 A 2/1988 Keller
4,804,165 A * 2/1989 Pippin ..... 254/30
5,022,632 A 6/1991 Beideck
5,224,687 A 7/1993 Geckler
D372,177 S 7/1996 Hansen
5,713,559 A * 2/1998 McClarin ..... 254/124
5,934,649 A 8/1999 Drane
6,131,884 A 10/2000 Broussard et al.
6,302,377 B1 10/2001 Pimentel
6,398,188 B1 * 6/2002 Salman ..... 254/30

* cited by examiner

*Primary Examiner*—Joseph J. Hail, III
*Assistant Examiner*—Daniel Shanley
(74) *Attorney, Agent, or Firm*—R. William Graham

(57) ABSTRACT

A device for removing post id provided and includes a movably disposable base which is capable of disposal at least partially circumferentially about the planted post, a diametrically adjustable member connected to the base for securely gripping about the post, and aback connected to the gripping member for mechanically displacing the gripping member and in turn the fence post from the ground.

13 Claims, 2 Drawing Sheets

DEVICE FOR PULLING A PLANTED POST FROM THE GROUND

BACKGROUND OF THE INVENTION

1. Field of the Invention

The present invention relates to devices used in cooperation with a jack to remove posts which are embedded in the ground. Posts are used for many applications, but may be for purposes herein can be of the type to support a fence. Over time, it is at many times necessary to remove them from the ground.

While prior devices for removing post are considered to be useful, often they are inconvenient to use, expensive to manufacture, and in some instances even dangerous to the individual using them. Accordingly, there exists a need for an improved post remover, that is easy to transport, effective, simple to use and is safe.

2. Description of Prior Art

Posts are commonly made of metal or wood, but may be of plastic or other material. A concrete footer is commonly employed to secure the post in the ground. Many times such posts are required to be removed. The removal of such post can be quite difficult.

Unsuccessful removal of a post by hand can result in a broken portion of the post and footer remaining secured in the ground. This necessitates digging around the footer to remove the concrete and attached post portion.

Further, posts come in a variety of cross-sectional shapes and diameters. The cross-section may be round or rectangular shaped, for example. Accordingly, prior post pulling tools are designed to remove a particular cross sectional shape.

For example, U.S. Pat. No. 5,224,687 issued to Geckler discloses a device for removing a post with a "T" shaped cross-section which utilizes an engagement plate and a conventional jack. Similarly, the post pulling apparatus described in U.S. Pat. No. 6,302,377 issued to Pimented uses a square sleeve adapted to receive a square post and has similar limitations. These representative prior art devices are limited to removing posts with a certain cross sectional shape and therefore cannot be used for removing stakes with differing cross-sectional shapes or sizes.

Further, prior post pullers typically must be placed over the top of the post or post and brought down to the proper position before removal. This requires the user to remove nails or other obstructions before the device can be used. Such a requirement increases the overall time and work required.

Accordingly, there is a need for a device which can quickly remove a post with minimal effort. Further, there is a need for a post puller that can remove posts of varying cross-sectional sizes and shapes. There also remains a need for a post puller which can remove post with an attached concrete footer thereto.

While the above described devices have similarities with the present invention, they differ in material respects. These differences reveal advantages over the prior devices.

SUMMARY OF THE INVENTION

It is an object of the present invention to provide a device for removing post from the ground.

It is also an object of the invention to reduce the amount of work required to remove post from the ground.

Another object of the invention is to provide a device for removing post which can dislodge an embedded fence post by engaging any exposed location along the length of the fence post.

Still another object of the invention is to provide a device for removing post that is easier and less costly to manufacture.

Yet another object of the invention is to provide a device for removing post that is compatible for use with a variety of jacks.

An object of the invention is to provide a device for removing post that is adapted to engage posts of varying sizes and shapes.

Another object of this invention is to provide a device that can pull wood or metal posts from the ground without requiring the user to exchange engagement heads.

Yet another object of the invention is to provide a device for removing post that is capable of at least partially circumferentially disposing its base about the post and an attached concrete footer in a manner which enables an upward force on the post parallel with the position of the post to remove both the post and concrete.

Another object of this invention is to provide a device for removing and transporting post of a variety of sizes and weights that is easy to use and easily operated by one person.

It is another object of the invention to provide a device for removing post which is durable in construction, compact and can be easily moved from place to place.

Another object of the invention is to provide a device for removing post which can be manufactured efficiently and reliably.

Further objects and advantages of the invention will be brought out in the following portions of the specification, wherein the detailed description is for the purpose of fully disclosing a preferred embodiment of the invention without placing limitations thereon.

Accordingly, there is provided a device for removing post that is constructed in accordance with the principles of the present invention. The device for pulling a post from the ground includes a movably disposable base which is capable of disposal about the planted post, a diametrically adjustable member connected to the base for securely gripping about the post, and a jack connected to the gripping member for mechanically displacing the gripping member and in turn the fence post from the ground. The base is generally U-shaped having a pair of opposing arms and a transverse portion connecting said arms in hereby said arms are disposable on about the post.

DETAILED DESCRIPTION OF THE INVENTION

Figures 1, 2:
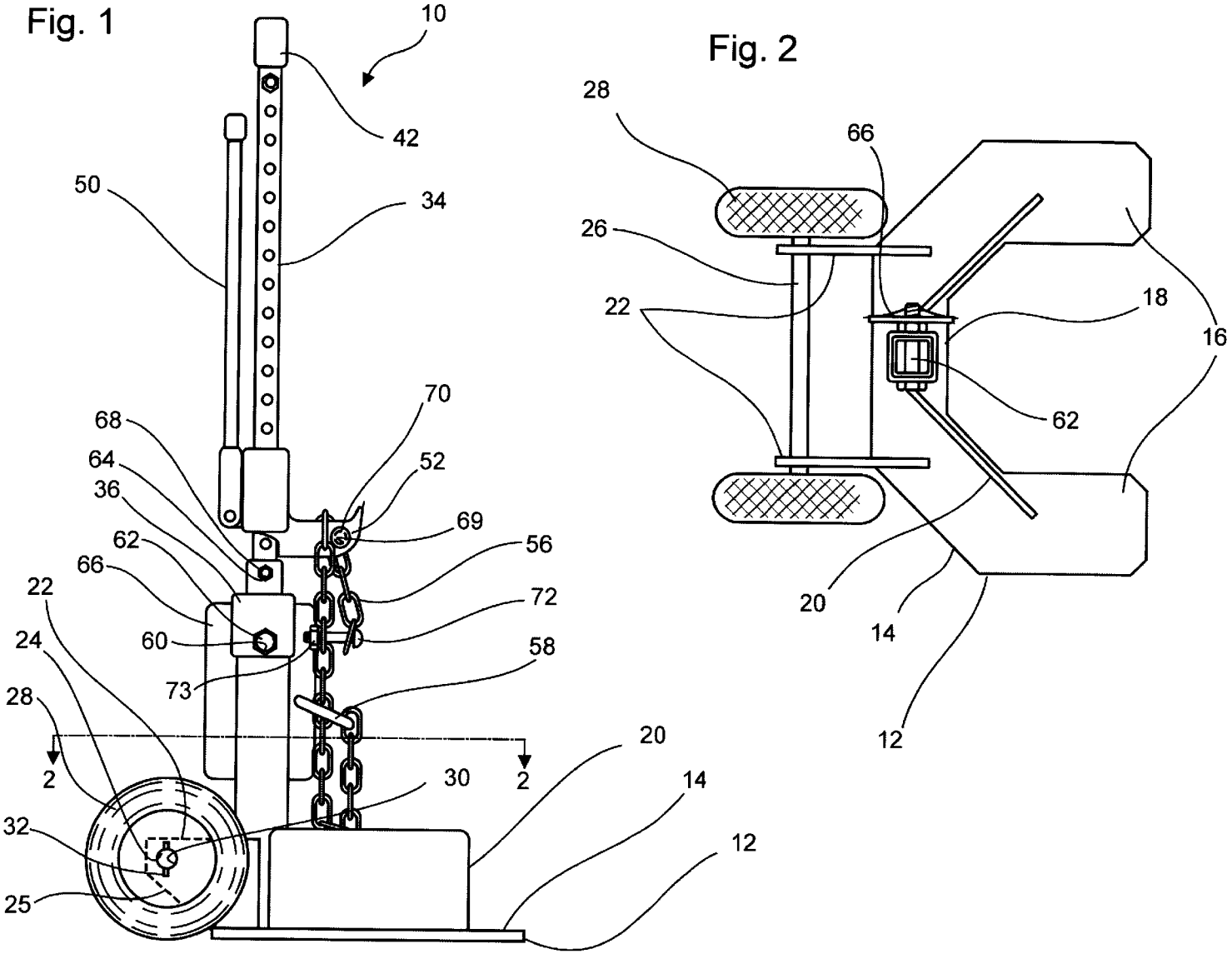
FIG. 1 is a side perspective of the device of the present invention.
FIG. 2 is a top view of base components of the invention.

Referring now to the drawings, the device for pulling fence post or the of the present invention is a generally designated by the numeral 10. The device includes a generally U-shaped base 12. The base 12 includes a plate member 14 of steel, for can be of any suitable rigid material. The base 12 has a pair of opposing arms 16 and transverse portion 18.

A pair of side plate members 20 which serve as upright side retaining members for the post P, which can also be steel, extend generally perpendicular to the base 12 and diagonally outward to form a V-shaped seat as seen in FIG. 2 which aid the transportation of the post P. The members 20 are fixed to the base 12 by welding. A pair of axle frame support members 22 can also be of steel and welded to base 12. The members 22 are tapered or angled having an axle bearing open surface 24 formed therein. A tapered portion 25 serves to provide clearance needed to tilt the device 10 when moving the same.

An axle 26 extends through the bearing open surface 24. Wheels 28 are attached to the axle 26. Bores 30 extend through the ends of the axle 26 to receive lock pins 32. By way of example, a vertical member 34, which can be steel, is connected via weld to the base 12 and members 20. The vertical member 34 can be steel tubing and of a predetermined height, say two feet to aid in leveraging the weight, transferring and transporting the post P. A universal sleeve neck 36 is connected, via welding for example, to the vertical member 34.

An elongated vertical jack portion 38 extends from the sleeve 36 and serves as a track for a jack head 44. The sleeve 36 can be such to accept a variety of vertical jack portion designs. The portion 38 includes a plurality of incrementally spaced surfaces 40 which terminate adjacent and upper capped end 42. The head 44 includes a sleeve 46, which slidably receives the vertical portion 38 therethrough. A ratchet arm 48 pivotally connects to the sleeve 46 to enable secure selective positioning of the sleeve 48 along the portion 38. A handle 50 is attached to the arm 48 and is provided as an additional leverage tool to achieve greater raising force with minimal exertion. Also, attached to the sleeve 46 is head 52. A chain 56 removably connects to the head 52 and is provided with a grab hook 58.

The vertical member 34 has a horizontal bore 60 through which a bolt 62 extends. A foot 66 rests on the end of the bolt 62 and is for use in supporting the vertical member 34 when not connected to the sleeve 36. When seated in the sleeve 36, a bolt 68 extends through a bore 64 of the sleeve 36 and one of the lower spaced surfaces 40 to secure the jack portion 38 to the sleeve 36.

Figure 3:
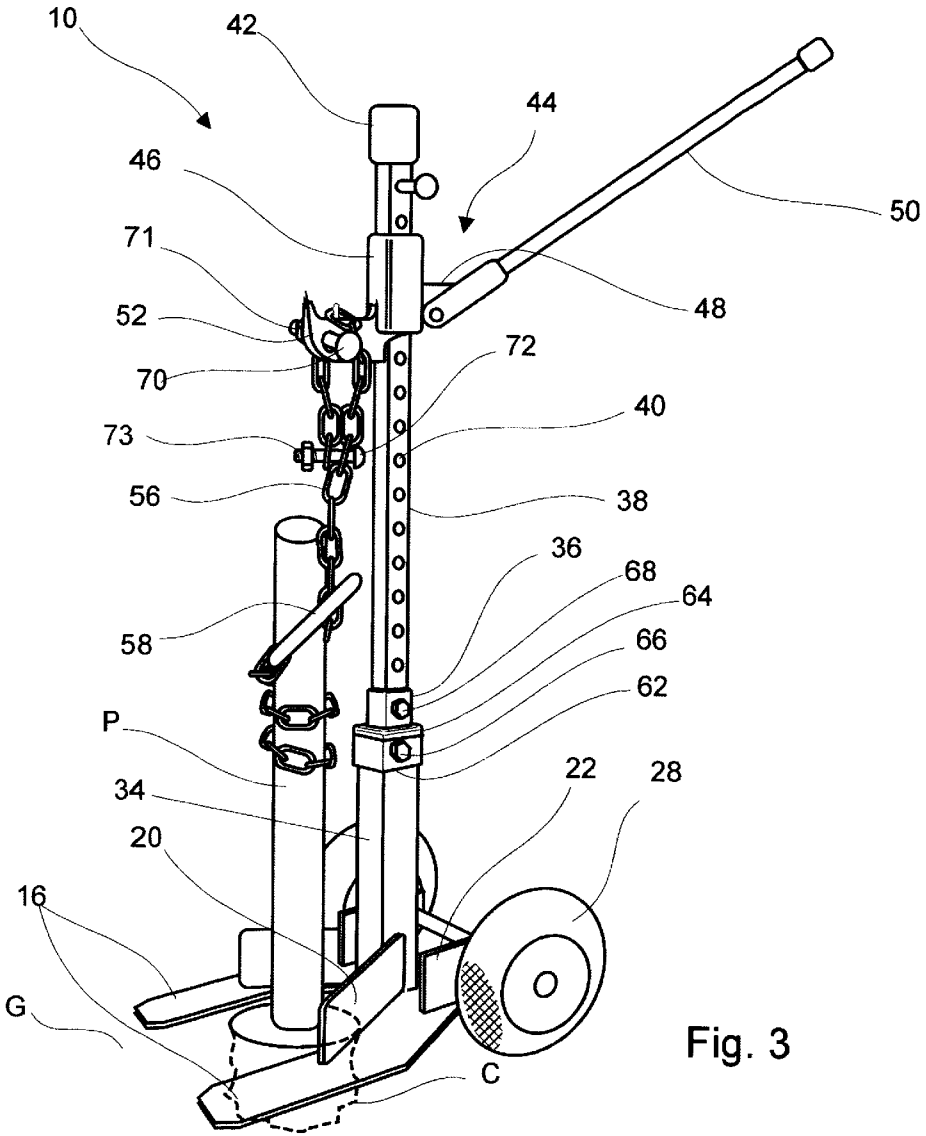
FIG. 3 is a perspective view of the invention in use

The head is formed with a bore 69 through which a bolt 70 extends and is fixed by a nut 71. The bolt 70 prevents a looped portion of the chain 56 as seen in FIGS. 1 and 3 from passing over the end of the head 52. The looped portion of the chain 56 is formed by connecting and end link of the chain 56 to another link by a bolt 72 and nut 73. Another end of the chain 56 is connected to an opening 75 of the hook 58. The hook 58 is configured with a slot 74 to enable it to be connected to another link in the chain 56 as seen in FIGS. 1 and 3.

Figure 4:
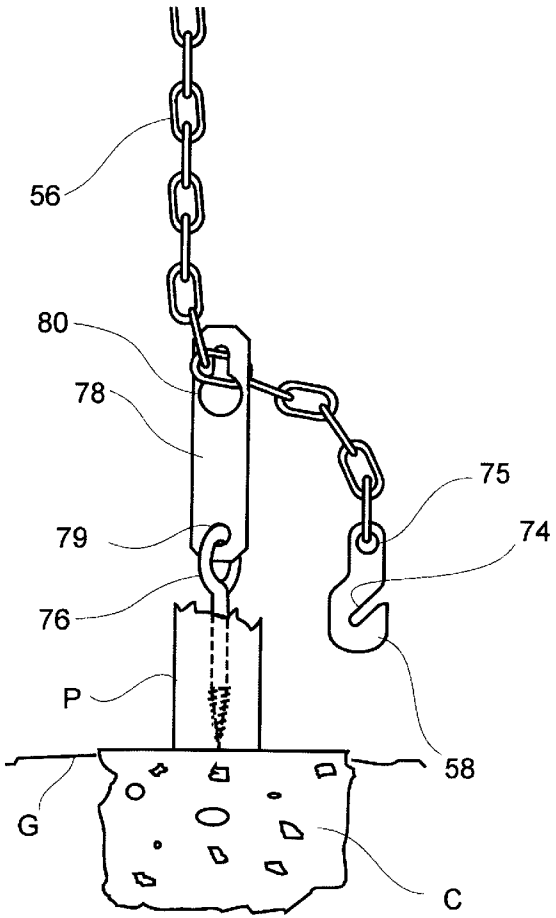
FIG. 4 is a view of a tool for aiding the device.

FIG. 4 depicts an eye bolt 76 and a plate 78 connected thereto at eyelet 79 which aid in removing broken post. Here, the bolt 76 screws into the remaining portion of the post. The plate 78 includes a keyed opening 80 for receiving the chain 56 therethrough in a fixed position.

The operation is as follows. The device 10 is configured to be wheeled over most terrain and disposed with its base 12 substantially encompassing an area in which the post P and a given amount of concrete disposed within the ground. The U-shaped base 12 is thus of a size such that the opening defined between the arms 16 and transverse portion 18 typically is large enough to enable the post P with an associated predetermined amount of concrete C to be pulled out of the ground G without having to disjoin the same. Once positioned, the chain 56 is wrapped about the post P and the hook 58 affixed to the head 52, for example. The jack 44 is then operated to cause the sleeve 46, head 52, chain 56 and in turn the post P to be vertically displaced from its planted position. Note, in the case of the broken post, the bolt 76 and tool 78 can be used as described above.

The side members 20 form a seat or cradle for the post P and associated concrete C once pulled from the ground G so that when the device 10 is tilted for transport, the post P and concrete C is securely held in place until the same is at a desired position for disposal.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A device for pulling a planted post from the ground, wherein the post has an end fixed in a concrete piece of a predetermined size sufficient to support the post and said device enables removal of the post with the concrete attached thereto, which includes:

a rollably movably disposable base which is capable of disposal about the planted post and wherein said base is generally U-shaped having a pair of opposing arms and a transverse portion connecting said arms, whereby said arms are sufficiently spaced from one another to be disposable on about the post and the concrete;

means for securely gripping about the post, wherein said gripping means is adjustable to retain various diameter sizes of the post;

means connected to said gripping means for mechanically displacing said gripping means and in turn the post from the ground with the thereon through and between said arms; and an upright side retaining seat member extending from said base configured to provide retaining support the concrete piece and the post during transportation after the post is removed from the ground.

2. The device for pulling a planted post of claim 1, wherein said base is a generally rigid plate member disposable adjacent the ground.

3. The device for pulling a planted post of claim 1, wherein said base includes least one wheel operably connected thereto to enable said device to be readily moved on said wheels.

4. The device for pulling a planted post of claim 1, wherein said wheel is connected to said base in a manner which renders said device movable upon tilting said base off the ground wherein a load is carried on an axis of said wheels.

5. The device for pulling a planted post of claim 1, wherein said gripping means includes a chain and hook.

6. The device for pulling a planted post of claim 1, wherein said displacing means includes a jack connected to said base.

7. The device for pulling a planted post of claim 1, wherein said jack extends vertically upward from said base.

8. The device for pulling a planted post of claim 1, wherein said jack includes a vertical extending member relative to said base being horizontally disposed and having a head capable of incrementally positioning along said vertical member.

9. The device for pulling a planted post of claim 1, wherein said head is hand actuated by a lever.

10. The device for pulling a planted post of claim 1, wherein said head is pneumatically actuated.

11. The device for pulling a planted post of claim 1, wherein said gripping means includes a chain and hook member.

12. The device for pulling a planted post of claim 5, which further includes a tool threadably insertably fixable to the post and which is connected to said chain for aiding in said displacement.

13. The device for pulling a planted post of claim 2, wherein said base is at least partially circumferentially disposed about the post.

* * * * *